US008505912B2

(12) United States Patent
Petermann et al.

(10) Patent No.: US 8,505,912 B2
(45) Date of Patent: Aug. 13, 2013

(54) DEVICE FOR ALIGNING NOTES OF VALUE

(75) Inventors: Udo Petermann, Altenbeken (DE); Paul Freitag, Steinheim (DE); Richard Düsterhus, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 13/398,193

(22) Filed: Feb. 16, 2012

(65) Prior Publication Data

US 2012/0211935 A1 Aug. 23, 2012

(30) Foreign Application Priority Data

Feb. 17, 2011 (DE) ..... 10 2011 000 782

(51) Int. Cl.
*B65H 9/00* (2006.01)
*B65H 9/12* (2006.01)
*B65H 9/16* (2006.01)

(52) U.S. Cl.
USPC ..... 271/239; 271/240; 271/241; 271/250

(58) Field of Classification Search
USPC ..... 271/239, 240, 241, 250, 171
See application file for complete search history.

(56) References Cited

U.S. PATENT DOCUMENTS

| | | | | |
|---|---|---|---|---|
| 4,607,831 | A * | 8/1986 | Raybuck | 271/240 |
| 4,657,239 | A * | 4/1987 | Ikesue et al. | 271/227 |
| 4,685,793 | A * | 8/1987 | Sawada et al. | 399/391 |
| 5,091,754 | A * | 2/1992 | Abe et al. | 399/394 |
| 5,172,138 | A * | 12/1992 | Okazawa et al. | 346/134 |
| 6,149,150 | A * | 11/2000 | Onipchenko et al. | 271/240 |
| 6,446,960 | B1 * | 9/2002 | Okada | 271/240 |
| 7,357,389 | B2 | 4/2008 | Landwehr | |
| 7,357,391 | B2 | 4/2008 | Landwehr | |
| 7,635,123 | B2 | 12/2009 | Watanabe et al. | |
| 7,762,547 | B2 * | 7/2010 | Nireki | 271/240 |
| 2002/0020737 | A1 | 2/2002 | Tamura | |
| 2005/0035538 | A1 * | 2/2005 | Jewell et al. | 271/240 |
| 2010/0264580 | A1 * | 10/2010 | Saltsov et al. | 271/240 |

* cited by examiner

*Primary Examiner* — David H Bollinger
(74) *Attorney, Agent, or Firm* — Harness, Dickey & Pierce, P.L.C.

(57) ABSTRACT

A device for aligning a sheet, such as a banknote. The device includes a support area on which at least one sheet to be aligned is supported. The device further includes a first aligning element and a second aligning element. The second aligning element is movable towards and away from the first aligning element. To align the sheet, the second aligning element is moved towards the first aligning element with a drive unit. A sensor is included that detects presence of the sheet in a detection area of the sensor. The drive unit is configured to move the second aligning element based on whether the sensor detects presence of the sheet.

17 Claims, 7 Drawing Sheets

DEVICE FOR ALIGNING NOTES OF VALUE

CROSS REFERENCE TO RELATED APPLICATIONS

This application claims the benefit and priority of German Patent Application No. 10 2011 000 782.2 filed Feb. 17, 2011. The entire disclosure of the above application is incorporated herein by reference.

BACKGROUND OF THE INVENTION

1. Field of the Invention

The invention relates to a device for aligning sheet-shaped media, which comprises a support area on which the at least one sheet-shaped medium to be aligned is supported. Further, the device has a first aligning element and a second aligning element movable in the direction of the first aligning element and opposite to this direction. For aligning the sheet-shaped medium, the second aligning element, when moved in the direction of the first aligning element, contacts an edge of the sheet-shaped medium and thus shifts the sheet-shaped medium in the direction of the first aligning element and/or rotates at least a corner of the sheet-shaped medium in the direction of the first aligning element. Further, the device has a drive unit for moving the second aligning element.

2. Discussion

In known devices for handling notes of value, the notes of value are input by a user in the form of a value note stack into an input and/or output compartment of the device. To guarantee a reliable further handling of the notes of value during processing in the device, in particular a reliable separation of the notes of value of the value note stack, it is necessary that the notes of value of the input value note stack are placed at least approximately into a preset target orientation. For this, known devices comprise two aligning devices which are moved toward each other along a preset travel path, while the value note stack is arranged between them. Here, the two aligning elements are moved toward each other until they have a preset distance to each other, this preset distance corresponding to the edge length of the note of value with the longest edge length.

What is problematic with such aligning units is that by means of them only notes of value with the longest edge length are aligned correctly. Notes of value with a smaller edge length, on the other hand, may remain extremely rotated so that these cannot be separated afterwards and/or may result in value note jams during the transport within the device for handling notes of value.

SUMMARY OF THE INVENTION

It is the object of the invention to specify a device for aligning sheet-shaped media, by means of which the sheet-shaped media can be aligned reliably in an easy manner.

By providing at least one sensor for detecting the presence of a sheet-shaped medium in its detection area, the position of the sheet-shaped medium and/or the orientation of the sheet-shaped medium on the support area and by taking into account the detected presence, the detected position and/or the detected orientation when moving the second aligning element for aligning the sheet-shaped medium, it is achieved that also smaller sheet-shaped media can be aligned reliably so that these, too, can be handled reliably. In particular, the aligning elements are not rigidly controlled but are controlled with respect to the supplied sheet-shaped media so that the control can be effected in accordance with the actual orientation, position and/or dimensions of the sheet-shaped medium.

The sheet-shaped media are in particular supported on the support area in the form of a stack consisting of a plurality of sheet-shaped media. The sheet-shaped media are in particular banknotes, checks, other notes of value and other sheet-shaped media. These different sheet-shaped media can in particular be supplied to the device in one single stack.

The device for aligning sheet-shaped media is in particular used in devices for handling notes of value, for example in automatic cash safes, automatic cash systems and/or automated teller machines, such as deposit machines for depositing banknotes and checks. In a particularly preferred embodiment, such a device for aligning notes of value is used in devices in which both banknotes and checks can be handled, wherein this inventive device for aligning the notes of value makes it possible that the banknotes and checks can be input together in one stack and can nevertheless be handled reliably by the device.

By aligning the sheet-shaped media it is in particular understood that the sheet-shaped media are placed into a preset orientation and/or their orientation is at least approximated to this preset orientation. The orientation is in particular defined by the position of the longer edges of the sheet-shaped media with respect to a transport direction of the sheet-shaped media. Here, the preset orientation is preferably preset such that the longer edges of a sheet-shaped medium that is oriented in the preset orientation are arranged parallel to the transport direction. In addition, the orientation of a sheet-shaped medium can also include the position of a center axis of the sheet-shaped media that is parallel to the longer edges of the sheet-shaped media with respect to a center axis of the support area that extends in transport direction. In this connection, the preset orientation is in particular preset such that the longitudinal axis of a sheet-shaped medium that is aligned in the preset orientation coincides with the longitudinal axis of the support area.

The transport direction is in particular the direction in which the sheet-shaped media are transported away from the support area for further processing. For this, in particular one or more transport elements, for example rollers and/or belts, are provided.

By position of a note of value the specific position is understood in which the sheet-shaped medium is arranged on the support area. When a sheet-shaped medium is transported in transport direction, without being laterally shifted transversely to the transport direction and without being rotated, indeed the position of the sheet-shaped medium is changed but not its orientation.

The device in particular comprises a control unit which drives the drive unit such that it moves the second aligning element dependent on the determined presence, the determined orientation and/or the determined position.

The second aligning element can have a substantially planar contact surface which contacts the sheet-shaped medium during alignment. The normal vector of this contact surface is in particular directed in the direction into which the drive unit moves the second aligning element for aligning the sheet-shaped medium. In this way, it is achieved that by a corresponding movement of the second aligning element the sheet-shaped medium is rotated in the direction of the first aligning element when the longer edges of the sheet-shaped medium are not yet arranged parallel to the contact surface. In this case, the second aligning element, when moved, contacts with its contact surface the edge of the sheet-shaped medium facing it in the area of one of the corners of the sheet-shaped medium and rotates the note of value by the contact with this edge in the direction of the first aligning element. When, on the other hand, the edge of the sheet-shaped medium facing the second aligning element is already oriented orthogonally to the normal vector then the contact surface contacts this edge over the entire length so that the sheet-shaped medium is shifted toward the first aligning element without a rotation in the direction of the normal vector.

In a particularly preferred embodiment of the invention, the second aligning element is moved transversely to the transport direction in which a transport unit for the transport of the sheet-shaped media transports these sheet-shaped media. Thus, by the corresponding movement of the second aligning element it is achieved that the sheet-shaped medium is rotated and/or shifted such that its longer edges are directed in transport direction so that the sheet-shaped medium can be reliably transported in transport direction by means of the transport unit and there is no danger that it gets jammed with other elements. In particular, a so-called short-side-first transport of the sheet-shaped media is possible in this way, in which the short edges of the note of value are oriented orthogonally to the transport direction and the long edges of the note of value are oriented parallel to the transport direction.

The sensor is in particular firmly connected to the second aligning element so that it is moved together with the second aligning element. A control unit controls the drive unit in particular such that it moves the second aligning element together with the sensor in the direction of the first aligning element until the sensor detects the presence of a sheet-shaped medium in its detection area. In this way, it is achieved that the movement of the second aligning element in the direction of the first aligning element takes place dependent on the width and/or the extent of the rotation of the sheet-shaped medium to be aligned so that it is reliably aligned.

In a particularly preferred embodiment of the invention, the sensor is a first sensor and at least one second sensor firmly connected to the second aligning element for detecting the presence of the sheet-shaped medium in its detection area, the position of the sheet-shaped medium and/or the orientation of the sheet-shaped medium on the support area is provided. In this case, the control unit controls the drive unit in particular such that it moves the second aligning element together with the two sensors in the direction of the first aligning element until both sensors detect the presence of a sheet-shaped medium in their respective detection area. In this way, it is achieved that the second aligning element is moved in the direction of the first aligning element until the longer edge of the sheet-shaped medium facing the second aligning element is oriented parallel to the second aligning element and thus parallel to the transport direction. Thus, it is guaranteed that the sheet-shaped medium, independent of its width, is rotated such that its longer edges run parallel to the transport direction so that the sheet-shaped medium can be transported easily.

When more than one sheet-shaped medium, in particular a stack of sheet-shaped media, are supported on the support area, then, by means of the appropriate movement of the second aligning element until both sensors detect the presence of a sheet-shaped medium in their detection area, it is achieved that at least the sheet-shaped media which have the largest width of all sheet-shaped media of the stack are placed into the preset orientation. Sheet-shaped media having a smaller width, on the other hand, can nevertheless still be rotated relative to the transport direction.

A counter-force required for rotating the sheet-shaped medium is in particular applied by the first aligning element against which the second aligning element presses the sheet-shaped medium upon movement of the second aligning element.

In a particularly preferred embodiment of the invention the first aligning element, too, is movable in the direction of the second aligning element and opposite to this direction, wherein the first aligning element, when moved in the direction of the second aligning element, contacts an edge of the sheet-shaped medium and shifts the sheet-shaped medium in the direction of the second aligning element and/or rotates at least one corner of the sheet-shaped medium in the direction of the second aligning element. Dependent on the presence detected by means of the sensor, the detected position or the detected orientation, a drive unit moves the first aligning element in the direction of the second aligning element. The drive unit can be the same drive unit that also moves the second aligning element or another drive unit. The drive unit or, respectively, the drive units preferably each comprise an electric motor for moving the aligning elements.

The sensor comprises, for example, a camera by means of which at least one image with a representation of the sheet-shaped medium to be aligned is captured. By means of preset image processing algorithms, the orientation, position and/or the dimensions of the sheet-shaped medium are determined dependent on the determined representation of the sheet-shaped medium. Dependent on the determined orientation, dimension and/or position the control unit then controls the drive unit for moving the second aligning element and/or the drive unit for moving the first aligning element so that, dependent on the actual orientation, position and/or dimensions of the sheet-shaped medium, the movement of the aligning elements toward each other takes place. In particular, dependent on the determined orientation and/or position of the sheet-shaped medium the control unit determines a travel path by which the second aligning element is to be moved in the direction of the first aligning element and/or a travel path by which the first aligning element is to be moved in the direction of the second aligning element. Subsequently, the control unit controls the drive unit or, respectively, the drive units such that the second aligning element and/or the first aligning element are respectively moved by it.

In an alternative embodiment of the invention, the first aligning element need not be controlled dependent on the same sensor as the second aligning element but a third sensor can be provided which is firmly connected to the first aligning element and is moved together therewith. In this embodiment, the aligning unit moves the first aligning element dependent on a presence of a sheet-shaped medium in the detection area of the third sensor detected by means of the third sensor, the position of the sheet-shaped medium detected by means of the third sensor and/or the orientation of the sheet-shaped medium detected by means of the third sensor.

In this embodiment, too, the first aligning element and the second aligning element can be moved by the same drive unit, or two drive units can be provided, wherein one drive unit each serves to move one of the aligning elements.

Movement of the first aligning element dependent on the third sensor can in particular be developed with the same features as described before in connection with the movement of the second aligning element dependent on the first sensor. Likewise, the first aligning element can be developed with the features described before in connection with the second aligning element. In a particularly preferred embodiment of the invention, the first aligning element and the second aligning element have the same structure.

The control unit controls the drive unit for moving the first aligning element in particular such that it moves the first aligning element together with the third sensor in the direction of the second aligning element until the third sensor detects the presence of a sheet-shaped medium in its detection area. In a particularly preferred embodiment of the invention, at least one fourth sensor firmly connected to the first aligning element is provided for detecting the presence of a sheet-shaped medium in its detection area, the position of the sheet-shaped medium and/or the orientation of the sheet-shaped medium. Here, the fourth sensor like the third sensor is moved together with the first aligning element. The control unit controls the drive unit for moving the first aligning element such that it moves the first aligning element together with the third sensor and the fourth sensor in the direction of the second aligning element until both the third sensor and the fourth sensor detect the presence of a sheet-shaped medium in its respective detection area. In this way, it is achieved that the first and the second aligning element are moved toward each other until all four sensors detect the presence of a sheet-shaped medium in their respective detection area. In this case, at least the sheet-shaped medium of the stack of sheet-shaped media that has the largest width of the sheet-shaped media has to be oriented such that its longer edges bear against the two aligning elements and are thus oriented parallel to the transport direction.

As a result of the two-sided rotation and/or shifting of the sheet-shaped medium by moving the two aligning elements toward each other on two sides an even more reliable and exacter alignment of the sheet-shaped medium is achieved.

In a particularly preferred embodiment of the invention the two aligning elements are moved toward each other until each of the four sensors detects the presence of a sheet-shaped medium in its respective detection area. Here, the two aligning elements are in particular moved by the same travel distance. In this case, movement of both aligning elements preferably takes place by means of the same drive unit. Alternatively, also two drive units can be provided, wherein one drive unit each serves to move one aligning element.

The first sensor, the second sensor, the third sensor and/or the fourth sensor preferably each comprise a light barrier by means of which the presence of a sheet-shaped medium in their detection areas can be detected easily. Here, in particular the presence of a sheet-shaped medium is detected when a light beam of the light barrier is interrupted by the sheet-shaped medium. The light barrier in particular comprises a deflection prism. Thus, a particularly cost-efficient and space-saving structure is achieved.

In an alternative embodiment of the invention, the sensors can, additionally or alternatively to the light barriers, also comprise sensors for measuring the force with which the respective aligning element presses against the sheet-shaped medium and, dependent on the determined force, detect the presence of a sheet-shaped medium.

Each of the first sensor, the second sensor, the third sensor and/or the fourth sensor is preferably arranged in an end region of the aligning elements. The first sensor and the second sensor are in particular arranged at opposite end regions of the second aligning element and/or the third sensor and the fourth sensor are arranged at opposite end regions of the first aligning element. By end region in particular the first and last quarter of the aligning elements, as viewed in transport direction, is understood. The distance between the sensors in transport direction is each time smaller than the length of the longer edge of the shortest admissible note of value.

In a preferred embodiment of the invention, the sheet-shaped medium is part of a stack of different or identical sheet-shaped media and the first aligning element and/or the second aligning element, when aligning the one sheet-shaped medium, also change the position and/or the orientation of at least one further sheet-shaped medium of the stack. Thus, it is achieved that a plurality of sheet-shaped media can be aligned jointly.

In a particularly preferred embodiment of the invention, after a first aligning operation, at least one sheet-shaped medium arranged at the front side of the stack is pulled off from the stack by means of a pull-off unit. Subsequently, the control unit controls the drive unit for moving the second aligning element such that it moves the second aligning element in the direction of the first aligning element when the first sensor and/or the second sensor no longer detect the presence of a sheet-shaped medium in their respective detection area after the one sheet-shaped medium has been pulled off. Additionally or alternatively, the drive unit for moving the first aligning element can be controlled by the control unit such that this drive unit moves the first aligning element in the direction of the second aligning element when the third sensor and/or the fourth sensor no longer detect the presence of a sheet-shaped medium in their respective detection area after the one sheet-shaped medium has been pulled off.

In this way, it is achieved that each time after a sheet-shaped medium has been pulled off, it is checked whether the pull-off of a further sheet-shaped medium is possible. Further, some sort of re-alignment is achieved by which the optimum possible alignment of the stack is always achieved. When all notes of value with the largest width have been pulled off from the value note stack, thus also the remaining sheet-shaped media with a smaller dimension are placed into the preset orientation.

In a particularly preferred embodiment of the invention, such a re-alignment of the remaining stack takes place after every pull-off of a sheet-shaped medium. Alternatively or additionally, the re-alignment can also take place every time after a preset number of sheet-shaped media has been pulled off.

By aligning operation is in particular understood in this connection the movement of the first and/or second aligning element in the direction of the respective other aligning element until all sensors moved therewith detect the presence of a sheet-shaped medium in their respective detection area.

In a further alternative embodiment of the invention, also more than two sensors can be firmly arranged on each aligning element and can be moved together with the respective aligning element. The more sensors are provided, the exacter the alignment of the sheet-shaped media will be.

BRIEF DESCRIPTION OF THE DRAWINGS

Further features and advantages of the invention result from the following description which in connection with the enclosed Figures explains the invention in more detail with reference to embodiments.

DETAILED DESCRIPTION OF THE PREFERRED EMBODIMENTS

Figure 1:
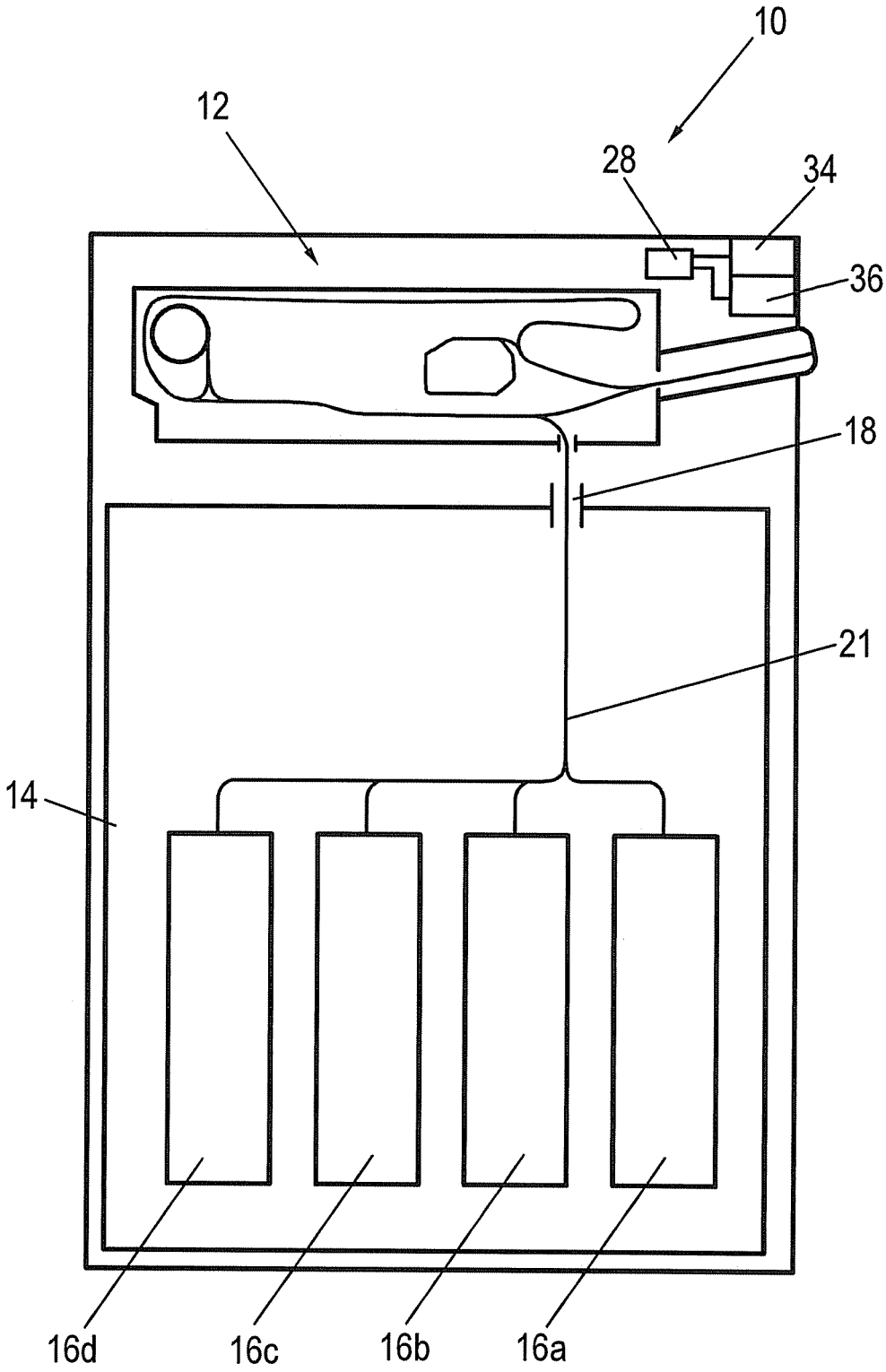
FIG. 1 shows a schematic illustration of a device for handling notes of value.

In FIG. 1, a schematic illustration of a device 10 for handling notes of value is illustrated. The device 10 is in particular an automatic cash safe, an automatic cash system and/or an automated teller machine, such as a deposit machine for depositing banknotes and checks.

The device 10 comprises a head module 12 and a safe 14. The structure of the head module 12 is described in more detail in connection with FIG. 2. In the safe 14, four value note cassettes 16*a* to 16*d* are arranged in which the notes of value can be held. Here, in particular one of the value note cassettes 16*a* to 16*d* is provided for holding checks and the other three value note cassettes 16*a* to 16*d* are provided for holding banknotes. The banknotes are in particular held in a type-specific manner, i.e. in one value note cassette 16*a* to 16*d* always only banknotes of one specific denomination are contained. Alternatively, also a mixed storage may be realized, i.e. that in one value note cassette 16*a* to 16*d* notes of value of different denominations are held in a mixed manner. In an alternative embodiment, also more than four or less than four, in particular two value note cassettes 16*a* to 16*d* can be provided in the safe 14. In particular, a so-called reject cassette can be provided in which notes of value are held that are suspected of being counterfeit and/or are damaged. In a preferred embodiment, two value note cassettes 16*a* to 16*d*, namely one for holding checks and one for holding banknotes are provided.

Here, the notes of value can be held in the value note cassettes 16*a* to 16*d* in stacked form in a receiving area as well as wound up between two film tapes onto a drum storage. Different types of value note cassettes can also be used within the safe 14.

In the present embodiment, the device 10 can be designed as a mere depositing device into which notes of value can only be deposited. Alternatively, it can also be designed as a recycling device into which notes of value can be deposited and can again be withdrawn therefrom.

The safe 14 has a transfer slot 18 through which the notes of value are supplied from the head module 12 to the safe 14. From the transfer slot 18, the notes of value are transported via a transport unit identified with the reference sign 21 to the value note cassettes 16*a* to 16*d*.

Figure 2:
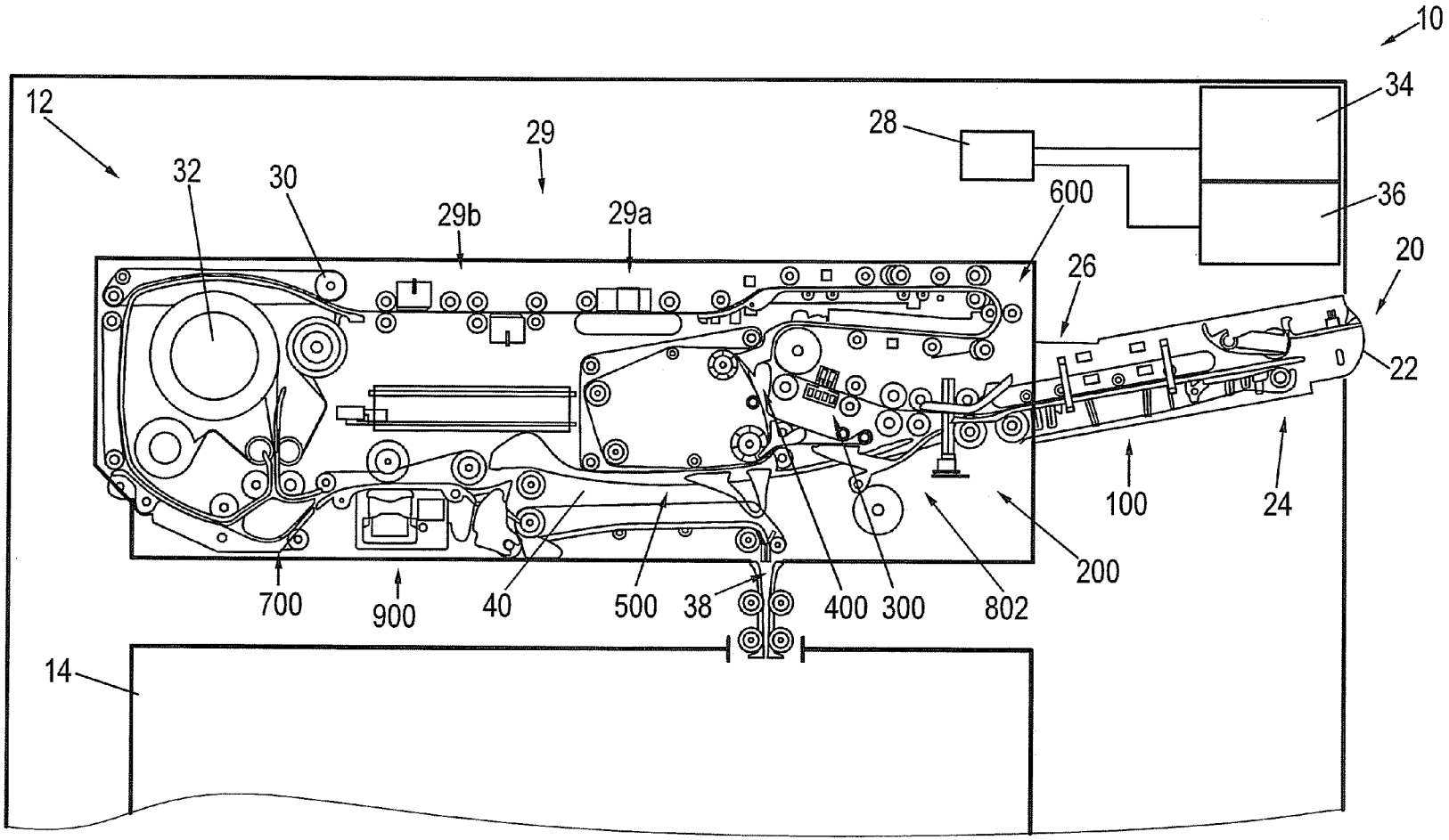
FIG. 2 shows a schematic illustration of a head module of the device according to FIG. 1.

In FIG. 2, a schematic illustration of the head module 12 according to FIG. 1 is shown. The head module 12 has an input and output unit 20 via which the notes of value can be input in the form of a value note stack. Further, via this input and output unit 20 individual notes of value and/or value note stacks can again be output to the user of the device 10. The input and output unit 20 in particular has a so-called shutter 22 by means of which an opening for feeding and outputting the notes of value can be opened and closed.

A value note stack input via the input and output unit 20 is transported to a first aligning unit 100 by means of a transport unit 24. By means of the first aligning unit 100, the notes of value of the value note stack are placed into a preset orientation or at least the orientation of a part of the notes of value of the value note stack is changed such that it is approximated to the preset orientation. By means of a transport unit 26, the aligned value note stack is supplied to a separating unit 200 which separates the notes of value of the value note stack and supplies the separated notes of value to a first sensor unit 300.

The first sensor unit 300 comprises an image capturing unit by means of which at least one image with a representation of this note of value is taken of each supplied note of value. Dependent on the representation of the note of value in the image, a control unit 28 of the device 10 determines at least one feature of the note of value and, dependent on this feature, classifies the note of value into checks, banknotes of a preset currency and other sheet-shaped media. The other sheet-shaped media can, for example, be notes of value of another currency than the preset one and/or other sheet-shaped media which were erroneously input by the user of the device. For example, these can be business cards or account statements. The preset currency is in particular the currency that is to be handled by means of the device 10, in particular that is to be held in the value note cassettes 16*a* to 16*d*.

Those notes of value that were neither classified as checks nor as banknotes of the preset currency will be transported via a sorting gate 400 into a second intermediate storage 500 for the intermediate storage of sheet-shaped media and will be intermediately stored therein preferably as a second value note stack. The checks and the banknotes of the preset currency, on the other hand, are supplied via the sorting gate 400 to a second aligning unit 600. By means of this second aligning unit 600 the checks are placed into a first preset target orientation and the banknotes are placed into a second target orientation differing from the first target orientation. In particular, several different target orientations for banknotes of different denominations are preset and the second aligning unit 600 places the notes of value not only into different preset target orientations dependent on whether checks or banknotes are concerned but additionally also dependent on the denomination of the banknotes.

The aligned notes of value are then supplied to a second sensor unit 29 by means of which the authenticity of the banknotes is determined and by means of which magnetic information on the checks is read out. The sensor unit 29 comprises a banknote sensor unit 29*a* by means of which the authenticity of the banknotes is verified and a check sensor unit 29*b* by means of which the authenticity of the checks is verified and information printed on the checks is read out. The first sensor unit 300 and the second sensor unit 29 form together with the control unit 28 in particular a non-counterfeit money and check detection module. In the determination of the authenticity of the banknotes and/or checks preferably also information determined by means of the sensor unit 300 is taken into account.

Subsequently, the notes of value are transported in the direction of a second sorting gate 700 by means of further transport elements, one of which is exemplarily identified with the reference sign 30. Via the second sorting gate 700, all notes of value of the previously input value note stack which were classified as checks or banknotes of the preset currency, are at first supplied to a first intermediate storage 32 and intermediately stored therein. The intermediate storage 32 is in particular designed in the form of a drum storage in which the notes of value to be held are held in a wound up manner between two film tapes. After all notes of value of the input value note stack are accommodated in the first intermediate storage 32 or the second intermediate storage 500, at least one information about the notes of value held in the first intermediate storage 32 and/or in the second intermediate storage 500 is output to the user via a display unit 34. This information in particular comprises information about the number of input notes of value and/or the value of the sum of the denominations of the input notes of value that are held in the first intermediate storage 32. Further, the user is in particular asked to input a confirmation information via an input unit 36.

When no confirmation information is input via the input unit 36 by the user within a preset time interval after request and/or when the user makes a negative input then the notes of value contained in the first intermediate storage 32 are transported away from this storage and are supplied to a stacking unit 40, by means of which a first value note stack is formed from all notes of value contained in the first intermediate storage 32. Further, the second value note stack contained in the second intermediate storage 500 is removed from the second intermediate storage 500. Both the first value note stack and the second value note stack are supplied to a stack combining unit 802 by means of which a single combined value note stack is formed from the first and the second value note stack. This combined value note stack is then again output to the user via the input and output unit 20.

When, on the other hand, the user inputs the confirmation information within the preset time interval after the respective request, then the second value note stack is removed from the second intermediate storage 500 and is output to a user via the input and output unit 20.

The notes of value intermediately stored in the first intermediate storage 32, on the other hand, are supplied along a transport path 38 to the safe 14 and are accepted in the value note cassettes 16*a* to 16*d*. Before they are transported into the safe 40, the checks intermediately stored in the first intermediate storage 32 are cancelled in that a cancellation print image is printed onto a preset print area of the check. For this, a printing unit 900 for printing the checks is provided between the second sorting gate 700 and the transport path 38. Via the sorting gate 700, the checks are supplied to the printing unit 900 such that the printing area on which the cancellation information is to be printed faces the print head of the printing unit 900 so that the print head can print the cancellation print image onto this printing area.

By means of the afore-described head module 12, it is achieved that in one device 10 checks and banknotes can be handled together and these can be supplied to the device in an arbitrarily mixed manner in one stack. In this way, a particularly high operating comfort is achieved for a user of the device 10 as the user does not have to manually presort the notes of value into checks and banknotes nor does he have to preset which type of notes of value is supplied, as is the case in known devices.

Figure 3:
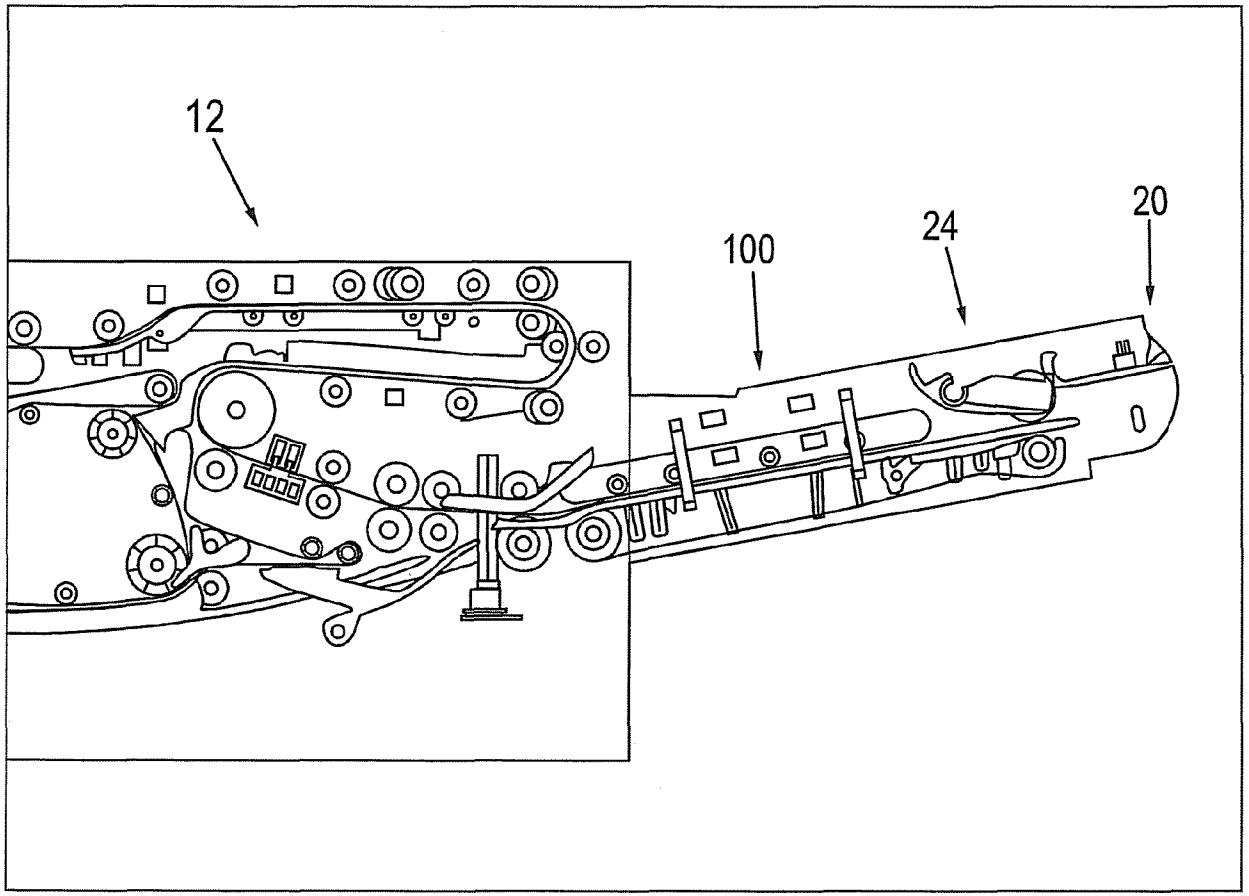
FIG. 3 shows a schematic illustration of a detail of the head module according to FIG. 2.
Figure 4:
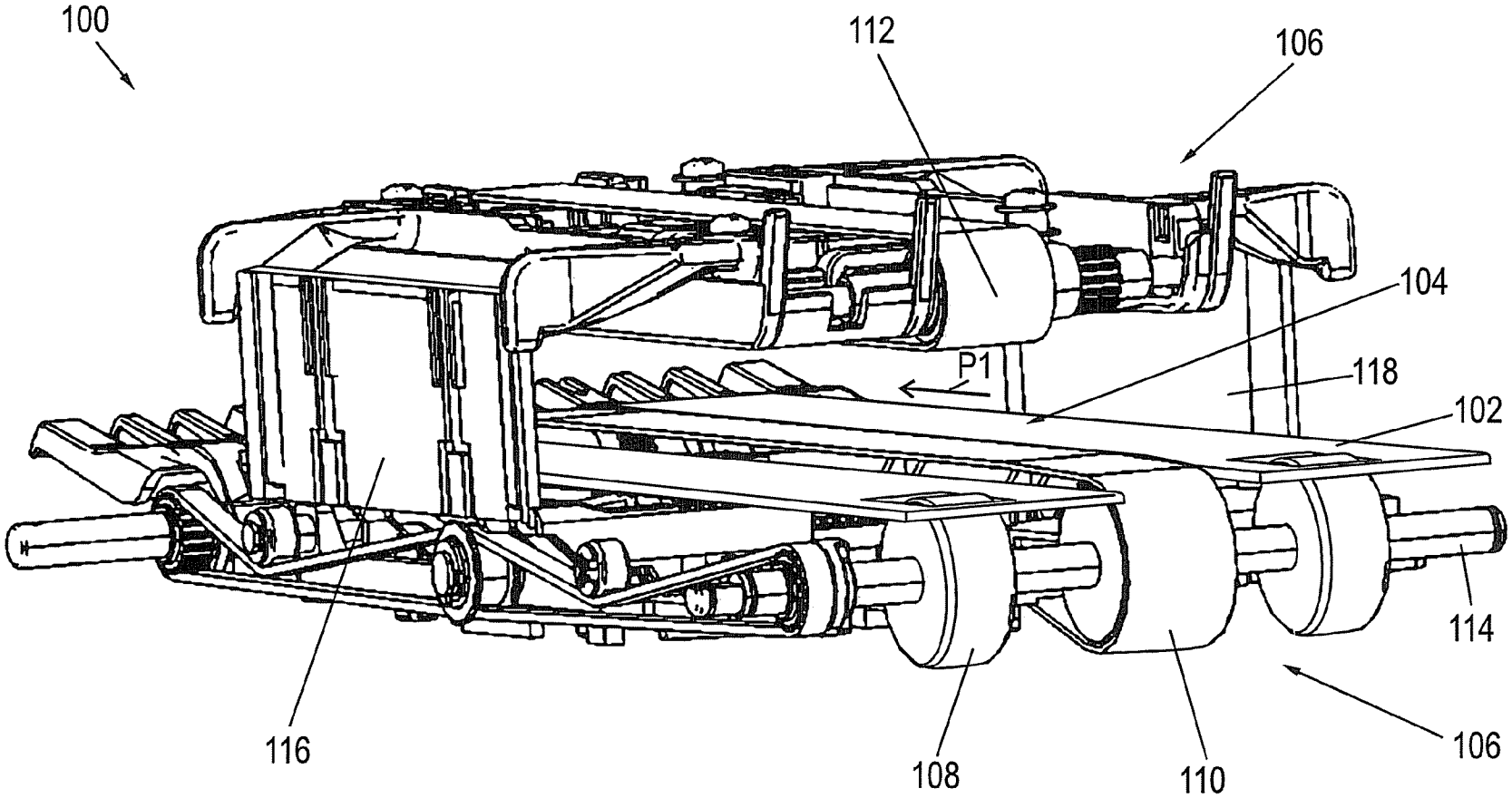
FIG. 4 shows a schematic perspective illustration of a device for aligning sheet-shaped media of the device according to FIGS. 1 to 3.
Figure 5:
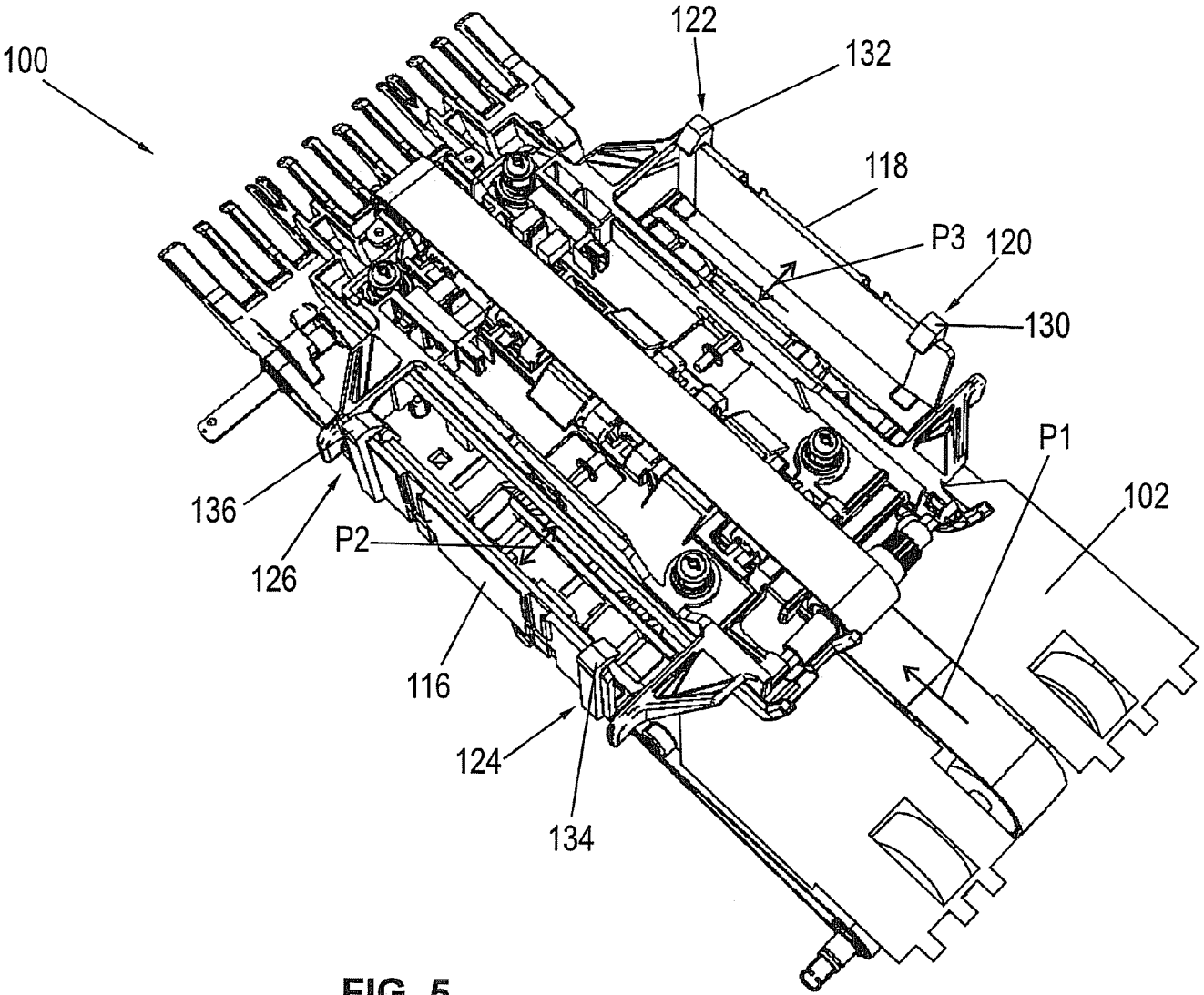
FIG. 5 shows a further schematic perspective illustration of the device according to FIG. 4.

In FIG. 3, a schematic view of a detail of the head module 12 is illustrated. FIGS. 4 and 5 show a respective schematic perspective illustration of the first aligning unit 100.

The first aligning unit 100 comprises a support element 102, the value note stack to be aligned being supported on a support area 104 of the support element 102 during alignment. Further, the first aligning unit 100 has a transport unit 106 by means of which the value note bundle is transported in a transport direction P1 coming from the input and/or output compartment 20 and thus can be supplied to the support area 104. After alignment, the transport unit 106 transports the value note stack further in transport direction P1 toward the separating unit 200.

The transport unit 106 comprises several driven rollers, one of which is exemplarily identified with the reference sign 108. In addition, the transport unit 106 comprises two driven belts 110, 112, wherein the belts 110, 112 are arranged such that the value note stack to be transported is arranged between them so that it is transported uniformly by the belts in transport direction P1. Both the belts 110, 112 and the rollers 108 are preferably driven by means of a central main drive of the device 10 that drives a plurality of transport elements of the device 10. For this, the rollers 108 and belts 110 and 112 are in particular mounted on driven shafts 114.

The aligning unit 100 comprises a first aligning element 116 and a second aligning element 118, wherein the support area 104 on which the value note stack to be aligned is supported during alignment on the support element 102 is formed between these two aligning elements 116, 118. Each of the aligning elements 116, 118 is arranged movably in the direction of the double arrows P2 and P3, respectively, by means of drive units. Here, for moving the first aligning element 116 a first drive unit and for moving the second aligning element 118 a second drive unit can be provided.

Alternatively, also only one drive unit can be provided, by means of which both aligning elements 116, 118 can be moved. The directions of movement P2, P3 of the aligning elements 116, 118 are in particular orthogonal to the transport direction P1.

On the second aligning element 118, a first sensor 120 and a second sensor 122 are arranged and firmly connected to the second aligning element 118. Upon movement of the second aligning element 118 in the direction of the double arrow P3, thus the sensors 120, 122 are moved as well. Analogous to this, on the first aligning element 116, a third sensor 124 and a fourth sensor 126 are arranged which are likewise firmly connected to the first aligning element 116 and are thus moved together therewith in the direction of the arrow P2.

Figure 6:
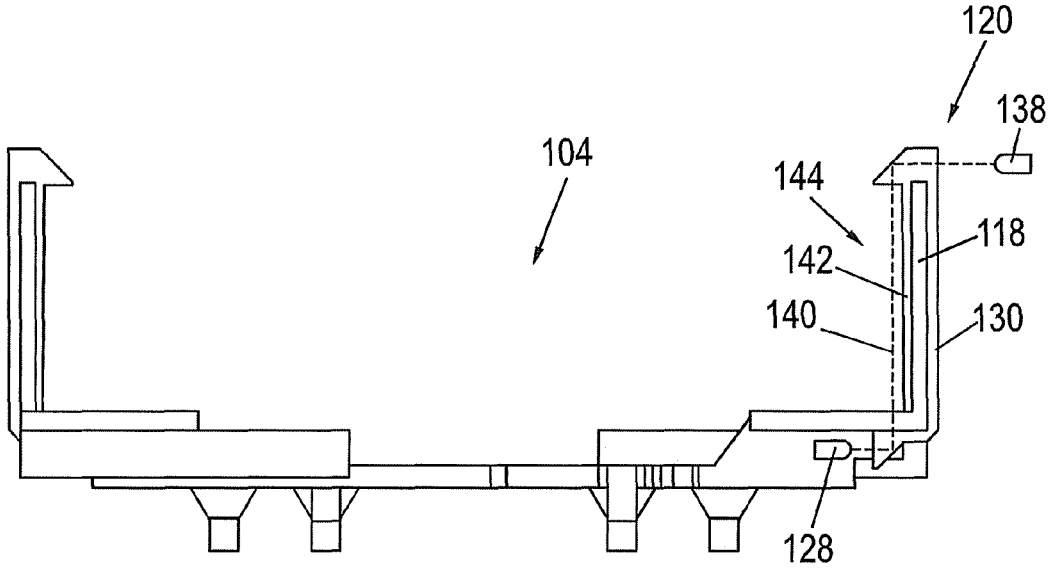
FIG. 6 shows a side view of a detail of the device according to FIGS. 4 and 5.

Each of the four sensors 120 to 126 comprises a light barrier by means of which a presence of a sheet-shaped medium in the detection area of the respective sensor 120 to 126 can be determined. Each of the light barriers of the four sensors 120 to 126 comprises two diodes 128, 138 and a prism 130 to 136. The structure and the function of the light barriers are exemplarily illustrated in FIG. 6 for the light barrier of the first sensor 120 and are described in more detail in the following. The explanations apply by analogy to the other three sensors 122 to 126.

The first diode 128 of the sensor 120 serves as an emitter diode by means of which a light beam 140 is emitted. This light beam is deflected by the prism 130 such that it is guided at the side of the second aligning element 118 facing the support area 104 parallel to the contact surface 142 of the second aligning element 118, by which contact surface the notes of value of the stack are contacted during alignment. At the upper side of the prism 128, the light beam 140 is again deflected and is guided to a second diode 138 that serves as a receiver diode. As long as no sheet-shaped medium is arranged in the detection area 144 of the first sensor 120, the light beam 140 emitted by the emitter diode 128 can be received by the receiver diode 138. If, on the other hand, a sheet-shaped medium is arranged in the detection area 144, then the light beam 140 is interrupted so that the receiver diode 138 detects the presence of a sheet-shaped medium in its detection area when it does not receive the emitted light beam.

Each of the four sensors 120 to 126 is arranged in end regions of the aligning elements 116, 118, the first sensor 120 being arranged at the front end of the second aligning element 118, as viewed in transport direction P1, the second sensor 120 being arranged at the rear end region of the second aligning element 118, as viewed in transport direction P1, the third sensor 124 being arranged at the front end region of the first aligning element 116, as viewed in transport direction P1, and the fourth sensor 126 being arranged at the rear end region of the first aligning element 116, as viewed in transport direction P1.

The functioning of the aligning unit 100 is described in the following in connection with FIGS. 7 to 10, wherein each of the FIGS. 7 to 10 illustrates a very simplified top view of the aligning unit 100. Further, for simplification of the explanation of the functioning, only one note of value 150 is illustrated in FIGS. 7 to 10, whose orientation is placed into the preset orientation by means of the aligning unit 100. The explanations apply by analogy to a value note stack consisting of several notes of value 150.

Figure 7:
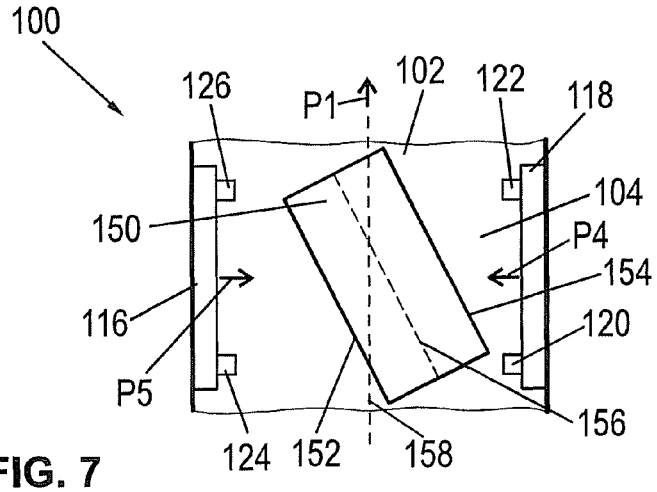
FIG. 7 shows a very simplified top view of the device according to FIGS. 4 to 6 in a first operating state.

In the initial situation illustrated in FIG. 7, the note of value 150 is arranged in the support area 104 of the support element 102 and is supported on the support element 102 in this support area 104. Here, the actual orientation of the note of value 150 is such that its longer edges 152, 154 are not arranged parallel to the transport direction P1. The preset orientation is preset such that the edges 152, 154 are aligned in parallel to the transport direction P1 and that the longer center axis 156 of the note of value 150 coincides with the center axis of the support element 102.

In the initial position shown in FIG. 7, the aligning elements 116, 118 are arranged at the edge of the support element 102. As none of the sensors 120 to 126 detects the presence of the sheet-shaped medium in its respective detection area, both the first aligning element 116 and the second aligning element 118 are moved toward each other in the direction of the arrows P4 and P5, respectively.

Figure 8:
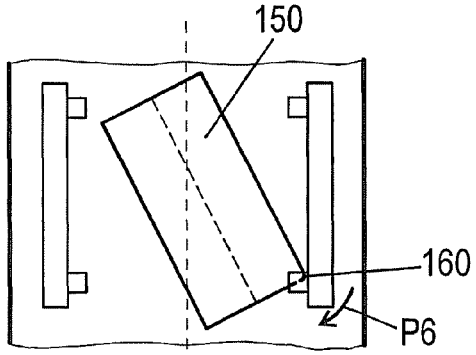
FIG. 8 shows a very simplified top view of the device according to FIGS. 4 to 7 in a second operating state.

In the state shown in FIG. 8, the aligning elements 116, 118 have been moved toward each other so far that by means of the first sensor 120 the presence of the sheet-shaped medium or, respectively, note of value 150 is detected in its detection area. Thus, the contact surface 142 of the second aligning element 118 contacts the edge 154 of the note of value 150. The second aligning element 118 is moved further in the direction of the arrow P4 and the first aligning element 116 is likewise moved further in the direction of the arrow P5. As a result thereof, the second aligning element 118 rotates the corner 160 of the note of value 150 in the direction of the arrow P6 by the contact with the edge 154.

Figure 9:
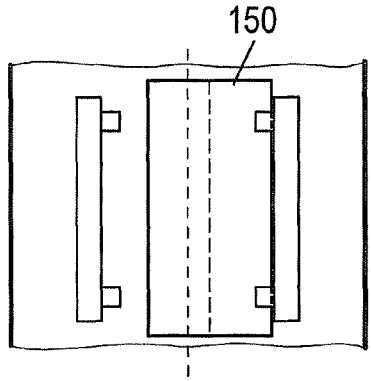
FIG. 9 shows a very simplified top view of the device according to FIGS. 4 to 8 in a third operating state.

In the state shown in FIG. 9, the note of value 150 has been rotated by means of the second aligning element 118 so far that its edges 152, 154 are aligned parallel to the transport direction P1. Here, the edge 154 of the note of value 150 contacts the contact surface 142 of the second aligning element 118 so that both the first sensor 120 and the second sensor 122 detect the presence of a sheet-shaped medium 150 in the respective detection area.

The third sensor 124 and the fourth sensor 126, on the other hand, do not yet detect the presence of the sheet-shaped medium 150 in their detection area so that the aligning elements 116, 118 are further moved toward each other. Here, via the contact of the second aligning element 118 with the edge 154 of the note of value 150 this note of value is moved together with the aligning element 118 in the direction of the arrow P4 toward the first aligning element 116.

Figure 10:
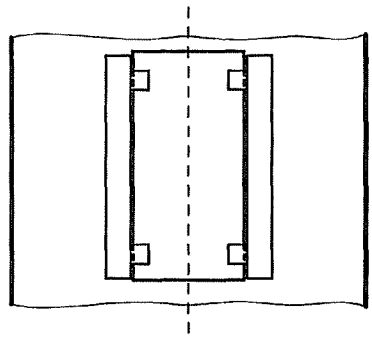
FIG. 10 shows a very simplified top view of the device according to FIGS. 4 to 9 in a fourth operating state.

In the state shown in FIG. 10, the note of value 150 is moved so far in the direction of the first aligning element 116 that the note of value 150 is oriented in the preset orientation. The edges 152, 154 are aligned parallel to the transport direction P1 and the center axis 156 of the note of value 150 coincides with the center axis 158 of the support element 102. All four sensors 120 to 126 now detect the presence of the note of value 150 in their respective detection area so that the aligning elements 116, 118 are not moved further toward each other.

Thereafter, the note of value 150 is transported away from the support area 104 in transport direction P1 by means of the transport unit 106 and supplied to the separating unit 200. By moving the aligning elements 116, 118 toward each other until all four sensors 120 to 126 detect the presence of a sheet-shaped medium 150 in the respective detection area, it is achieved that the sheet-shaped medium 150 can easily and reliably be placed into the preset orientation independent of its dimensions and its initial orientation and initial position so that a reliable further handling of the sheet-shaped medium 150 is achieved.

As already described before, in the device 100 usually not single sheet-shaped media 150 but stacks of sheet-shaped media 150 are inserted. These sheet-shaped media 150 in particular have different dimensions, wherein the media 150 may differ from each other both in their length and in their width. The input of the stack in particular takes place short-side-first, i.e. the sheet-shaped media are input such that their longer sides are aligned parallel to the transport direction. Alignment of such supplied stacks takes place in the same manner as previously described in connection with FIGS. 7 to 10 for the one note of value 150.

After the aligning elements 116, 118 have been moved toward each other so far that all sensors 120 to 126 detect the presence of a sheet-shaped medium 150 in their respective detection area, the sheet-shaped medium 150 that is supported on the support element 106 is pulled off by means of the separating unit 200 and is transported further in transport direction P1. As long as all four sensors 120 to 126 still detect the presence of a sheet-shaped medium 150 in their respective detection area, one further sheet-shaped medium 150 after the other is pulled off from the stack until at least one of the sensors 120 to 126 no longer detects the presence of a sheet-shaped medium 150 in its detection area. In this case, the aligning elements 116, 118, as described before, are again moved further toward each other until all four sensors 120 to 126 again detect the presence of a sheet-shaped medium 150 in their detection area. In this way, a re-alignment of the stack is achieved in the case of differently wide sheet-shaped media 150, during which, when all sheet-shaped media with a larger width have been pulled off, also the sheet-shaped media 150 with a smaller width are placed into the preset orientation.

By width of a sheet-shaped medium 150 in particular the dimension of this sheet-shaped medium 150 directed transversely to the transport direction P1 is understood.

In a further alternative embodiment of the invention, also more or less than four sensors 120 to 126 can be provided. Likewise, it is alternatively possible that one of the aligning elements 116, 118 is stationary and only the other aligning element 116, 118 is movable and is moved toward the stationary aligning element 116, 118 for aligning the sheet-shaped media 150.

In a further alternative embodiment, instead of light barriers also force sensors can be used, by means of which the force required for moving the aligning elements 116, 118 in the direction of the arrows P4 and P5, respectively, is determined. With the aid of this determined force, it is detected whether at least one of the sheet-shaped media of the stack is already oriented in the preset orientation or whether still a shifting or rotation of the sheet-shaped media is necessary for placing these into the preset orientation.

Further, a camera can alternatively be provided as a sensor, by means of which the orientation and/or position of at least one sheet-shaped medium 150 of the stack, in particular of all sheet-shaped media 150 of the stack is determined. Thereafter, the control unit 28 of the device 10 determines therefrom by which travel paths the aligning elements 116, 118 have to be moved to place the sheet-shaped medium or the sheet-shaped media 150 into the preset orientation.

What is claimed is:

1. A device for aligning sheets, in particular notes of value, comprising:

a support area on which at least one sheet to be aligned is supported, a first aligning element, a second aligning element movable towards and away from the first aligning element to align the sheet, when moved toward the first aligning element the second aligning element contacts an edge of the sheet and shifts the sheet toward the first aligning element and/or rotates the sheet so that at least one corner of the sheet moves toward the first aligning element, a drive unit for moving the second aligning element, and at least one sensor for detecting presence of a sheet in a detection area of the sensor, the position of the sheet and/or the orientation of the sheet on the support area is detected, wherein the drive unit moves the second aligning element for aligning the sheet dependent on the detected presence, the detected position, and/or the detected orientation of the sheet.

2. The device according to claim 1, wherein the second aligning element has a substantially planar contact surface which contacts the sheet during alignment, in that the drive unit moves the second aligning element for aligning the sheet in a direction of a normal vector of the contact surface.

3. The device according to claim 1, wherein a transport unit for the transport of the sheet in a transport direction is provided, the transport direction is perpendicular to the direction in which the second aligning element is moved for aligning sheet.

4. The device according to claim 1, wherein the sensor is connected to the second aligning element.

5. The device according to claim 4, wherein a control unit controls the drive unit such that it moves the second aligning element together with the sensor in the direction of the first aligning element until the sensor detects the presence of a sheet in the detection area of the sensor.

6. The device according to claim 4, wherein the sensor is a first sensor, at least one second sensor connected to the second aligning element is provided for detecting presence of a sheet in a detection area of the second sensor, the position of the sheet, and/or the orientation of the sheet on the support area;

wherein a control unit controls movement of the drive unit, the control unit controls the second aligning element together with the first and second sensors depending on the presence of the sheet detected by the second sensor, the position of the sheet detected by the second sensor and/or the orientation of the sheet detected by the second sensor such that the drive unit moves the second aligning element together with the first and second sensors in the direction of the first aligning element until both the first and the second sensors detect presence of a sheet in the respective detection areas of the first sensor and the second sensor.

7. The device according to claim 6, wherein the first sensor is arranged at a front end region of the second aligning element, as viewed in a transport direction, and the at least one second sensor is arranged at a rear end region of the second aligning element, as viewed in the transport direction.

8. The device according to claim 1, wherein the second aligning element presses the sheet against the first aligning element.

9. The device according to claim 1, wherein the first aligning element is movable towards and away from the second aligning element such that the first aligning, when moved toward the second aligning element, contacts an edge of the sheet and shifts the sheet towards the second aligning element and/or rotates the sheet so that at least one corner of the sheet moves towards the first aligning element and in that a drive unit moves the first aligning element for aligning the sheet dependent on the detected presence, the detected position and/or the detected orientation of the sheet.

10. The device according to claim 1, wherein the first aligning element is movable towards and away from the second aligning element, the first aligning element, when moved toward the second aligning element, contacts an edge of the sheet and shifts the sheet in the direction of the second aligning element and/or rotates the sheet so that at least one corner of the sheet moves towards the first aligning element, at least one third sensor connected to the first aligning element detects presence of a sheet in a detection area of the third sensor, the position of the sheet, and/or the orientation of the sheet on the support area; and wherein a drive unit moves the first aligning element for aligning the sheet dependent on the presence of the sheet detected by the third sensor, the position of the sheet detected by the third sensor, and/or the orientation of the sheet detected by the third sensor.

11. The device according to claim 10, wherein the control unit controls the drive unit to move the first aligning element together with the third sensor towards the second aligning element until the third sensor detects the presence of a sheet in the detection area of the third sensor.

12. The device according to claim 10, wherein at least one fourth sensor connected to the first aligning element is provided for detecting the presence of a sheet in a detection area of the third sensor, the position of the sheet and/or the orientation of the sheet on the support area, and in that the control unit controls the drive unit for moving the first aligning element together with the third sensor and the fourth sensor towards the second aligning element until the third sensor and the fourth sensor detect the presence of a sheet in the respective detection areas of the first, second, third, and fourth sensors.

13. The device according to claim 10, wherein at least one fourth sensor connected to the first aligning element is provided for detecting the presence of a sheet in a detection area of the fourth sensor, the position of the sheet and/or the orientation of the sheet on the support area, and in that the drive unit or, respectively, the drive units move the first and second aligning elements toward each other until each of the first sensor, the second sensor, the third sensor and the fourth sensor detect the presence of a sheet in the respective detection areas of the first, second, third, and fourth sensors.

14. The device according to claim 13, wherein the drive unit or, respectively, the drive units move the first aligning element and the second aligning element by the same distance.

15. The device according to claim 12, wherein the first sensor, the second sensor, the third sensor and/or the fourth sensor each comprise a light barrier.

16. The device according to claim 1, wherein the sheet is part of a stack of different and/or identical sheets, and in that the first aligning element and/or the second aligning element when aligning the one sheet also change the position and/or orientation of at least one further sheet of the stack to align the further sheet.

17. The device according to claim 1, wherein the sensor is a first sensor the sheet is part of a stack of different and/or identical sheets, after a first aligning operation, at least one sheet arranged at an end of the stack is pulled off the stack, the control unit controls the drive unit to move the second aligning element in the direction of the first aligning element when the first sensor, a second sensor, a third sensor and/or a fourth sensor do not detect the presence of a sheet in their respective detection areas, and/or controls the drive unit to move the first aligning element such that it moves the first aligning element towards the second aligning element when the first sensor, the second sensor, the third sensor and/or the fourth sensor do not detect the presence of a sheet in the respective detection areas of the first, second, third, and fourth sensors.

* * * * *